US009950545B2

(12) United States Patent
Yoshinuma

(10) Patent No.: US 9,950,545 B2
(45) Date of Patent: Apr. 24, 2018

(54) DRYING DEVICE AND DRYING SYSTEM

(71) Applicant: Toshihiro Yoshinuma, Kanagawa (JP)

(72) Inventor: Toshihiro Yoshinuma, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/281,410

(22) Filed: Sep. 30, 2016

(65) Prior Publication Data

US 2017/0120625 A1 May 4, 2017

(30) Foreign Application Priority Data

Oct. 29, 2015 (JP) ..... 2015-212807

(51) Int. Cl.
*B41J 11/00* (2006.01)
*B41M 7/00* (2006.01)
*B41J 15/04* (2006.01)

(52) U.S. Cl.
CPC ..... *B41J 11/002* (2013.01); *B41M 7/00* (2013.01); *B41J 15/04* (2013.01)

(58) Field of Classification Search
CPC ..... B41M 5/0011; B41J 11/002
See application file for complete search history.

(56) References Cited

U.S. PATENT DOCUMENTS

2005/0207770 A1* 9/2005 Nihonyanagi ..... G03G 15/2025 399/67
2005/0212882 A1* 9/2005 Naniwa ..... B41J 11/0015 347/102
2014/0232797 A1* 8/2014 Onodera ..... B41F 23/042 347/102
2014/0270824 A1* 9/2014 Satoh ..... G03G 15/2042 399/45
2016/0273832 A1 9/2016 Asada et al.

FOREIGN PATENT DOCUMENTS

JP 2001-343857 12/2001
JP 2012-226387 11/2012
JP 2012226837 A * 11/2012
JP 2016-173191 9/2016

* cited by examiner

*Primary Examiner* — Sharon A Polk
(74) *Attorney, Agent, or Firm* — Cooper & Dunham LLP

(57) ABSTRACT

A drying device for drying a recording medium is provided. The drying device includes a plurality of heating roller units independently detachable from the drying device. The heating roller units includes at least one upstream heating roller unit disposed upstream relative to a conveyance direction of the recording medium and at least two downstream heating roller units disposed downstream relative to the conveyance direction of the recording medium. Each upstream heating roller unit includes an upstream heating roller, two upstream temperature detectors, and two upstream controllers. The upstream heating roller includes two upstream heat sources having different heating areas. The two upstream temperature detectors are disposed at respective end parts of the upstream heating roller, to detect temperatures of the respective upstream heat sources to output signals. The two upstream controllers control the respective upstream heat sources based on the respective signals from the respective upstream temperature detectors.

10 Claims, 7 Drawing Sheets

DRYING DEVICE AND DRYING SYSTEM

CROSS-REFERENCE TO RELATED APPLICATIONS

This patent application is based on and claims priority pursuant to 35 U.S.C. § 119(a) to Japanese Patent Application No. 2015-212807, filed on Oct. 29, 2015 in the Japan Patent Office, the entire disclosure of which is hereby incorporated by reference herein.

BACKGROUND

Technical Field

The present disclosure relates to a drying device and a drying system.

Description of the Related Art

A printing system is known which includes: a printing device for printing images on a rolled sheet; a post-processing device for winding up the rolled sheet having a printed image thereon; and a drying device provided between the printing device and the post-processing device, for enhancing the fixation strength of the image (e.g., ink) on the sheet. Such a drying device for drying a recording medium to which ink or a pretreatment liquid is applied is generally equipped with a heating roller containing a heat source (e.g., halogen lamp). The heating roller of the drying device is preferably variable in heating width, to effectively dry variety of recording media varied in properties such as width, specific heat, and thermal conductivity.

A typical heating roller contains multiple heat sources having different heating areas. Which heat source to generate heat is selected based on the width of a recording medium to be dried by the drying device. Each heat source has a controller that controls input power of the heat source. For example, a heating roller for use in fixing devices generally contains 4 to 5 heat sources.

On the other hand, a drying device which includes multiple heating rollers further includes the corresponding amount of controllers, thus making the control and configuration of the drying device more complicated. For example, when the number of heating rollers is 6, about 30 controllers are needed.

SUMMARY

In accordance with some embodiments of the present invention, a drying device for drying a recording medium is provided. The drying device includes a plurality of heating roller units independently detachable from the drying device. The heating roller units includes at least one upstream heating roller unit disposed upstream relative to a conveyance direction of the recording medium and at least two downstream heating roller units disposed downstream relative to the conveyance direction of the recording medium. Each upstream heating roller unit includes an upstream heating roller, two upstream temperature detectors, and two upstream controllers. The upstream heating roller includes two upstream heat sources having different heating areas. The two upstream temperature detectors are disposed at respective end parts of the upstream heating roller, to detect temperatures of the respective upstream heat sources to output signals. The two upstream controllers control the respective upstream heat sources based on the respective signals from the respective upstream temperature detectors.

In accordance with some embodiments of the present invention, a drying system is provided. The drying system includes a printing device and the above drying device. The printing device prints an image on a recording medium. The drying device dries the recording medium having a printed image.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
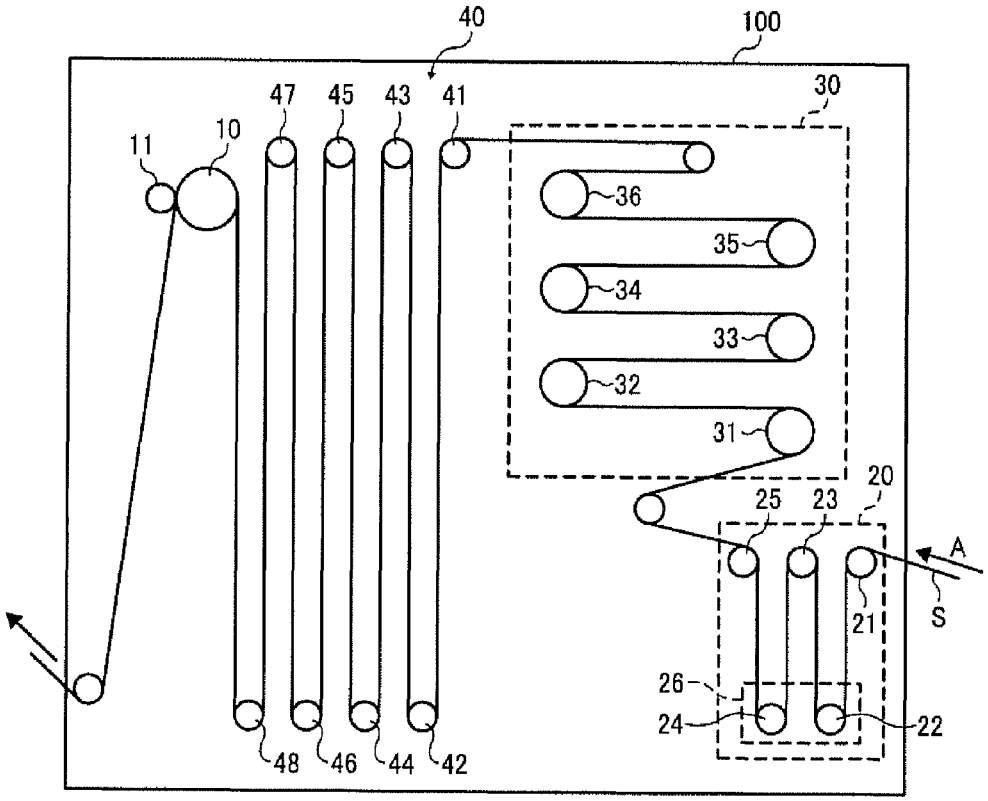
FIG. 1 is a schematic view of a drying device according to an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition done or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

FIG. 1 is a schematic view of a drying device 100 according to an embodiment of the present invention.

The drying device 100 includes a conveyance roller 10 for conveying a sheet S (serving as a recording medium), disposed on a downstream side relative to a sheet conveyance direction. The conveyance roller 10 conveys the sheet S in a direction indicated by arrow A in FIG. 1.

The drying device 100 further includes a buffer unit 20, a sheet drying unit 30, and a sheet cooling unit 40.

The buffer unit 20 is disposed on an upstream side in the drying device 100 relative to the sheet conveyance direction. The buffer unit 20 secures a predetermined amount of buffer in the vicinity of the inlet port of the drying device 100. The buffer unit 20 includes multiple rollers 21, 22, 23, 24, and 25 (hereinafter collectively "rollers 21 to 25") to which the sheet S is wound around. The rotation speed of the conveyance roller 10 is variable-controlled so as to secure the predetermined amount of buffer when the conveyance roller 10 conveys the sheet S. Thus, the conveyance roller 10 conveys the sheet S at a constant speed. Among the rollers 21 to 25, the two rollers 22 and 24, positioned at a lower part of the drying device 100, are disposed in a lifting and lowering device 26 to be movable up and down. The amount of buffer is variable by varying the positions of the two rollers 22 and 24.

The sheet S is conveyed from the buffer unit 20 to the sheet drying unit 30.

As illustrated in FIG. 1, the sheet drying unit 30 includes multiple heating rollers 31, 32, 33, 34, 35, and 36 (hereinafter collectively "heating rollers 31 to 36") arranged in a zigzag manner and to which the sheet S is wound around. Each of the heating rollers 31 to 36 contains a halogen lamp (serving as a heat source) inside. Each of the heating rollers 31 to 36 transfers heat to the sheet S by contact with the sheet S, thereby drying the sheet S. Hereinafter, the heating rollers 31 and 32 disposed upstream relative to the sheet conveyance direction are referred to as "upstream heating rollers 31 and 32", and the heating rollers 33 to 36 disposed downstream relative to the sheet conveyance direction are referred to as "downstream heating rollers 33 to 36", respectively.

The upstream heating rollers require a greater ability of heating the sheet S than the downstream heating rollers. This is because heat from the upstream heating rollers is drawn by the sheet S without being supplied to ink on the sheet S.

When the sheet S is heated to a specific temperature or above by heat from the upstream heating rollers, heat from the downstream heat rollers 33, 34, 35, and 36 is used for drying ink on the sheet S.

The number of heating rollers disposed in the sheet drying unit 30 is six. In this case, two of the heating rollers disposed on an upstream side relative to the sheet conveyance direction, i.e., the upstream heating rollers 31 and 32, are given an ability for sufficiently heating the sheet S.

The sheet drying unit 30 has an enclosed space. The internal heat of the sheet drying unit 30 is thermally insulated by a heat insulating material disposed around the sheet drying unit 30, so as not to leak to the outside of the sheet drying unit 30. Owing to this configuration, the internal space of the chamber of the sheet drying unit 30 has a temperature higher than that of the surrounding area of the sheet drying unit 30.

As the space within the chamber is heated by heat generated from the heating rollers, in each space between the heating rollers 31 to 36, the sheet S is allowed to dry owing to heat transfer caused by convection of high-temperature air. Therefore, a heater only for heating the internal space is needless.

The sheet S is then conveyed from the sheet drying unit 30 to the sheet cooling unit 40.

The sheet cooling unit 40 includes multiple guide rollers 41, 42, 43, 44, 45, 46, 47, and 48 (hereinafter collectively "guide rollers 41 to 48") arranged in a zigzag manner and to which the sheet S is wound around. The sheet S conveyed from the sheet drying unit 30 is cooled while being conveyed between the guide rollers 41 to 48.

Within the space of the sheet cooling unit 40, the temperature of the sheet S is controllable by means of blowing of external air or changing of the conveyance distance.

The sheet S conveyed from the sheet cooling unit 40 is passed through a nip between the conveyance roller 10 and a nip roller 11 and conveyed to the outside of the drying device 100.

Figure 2:
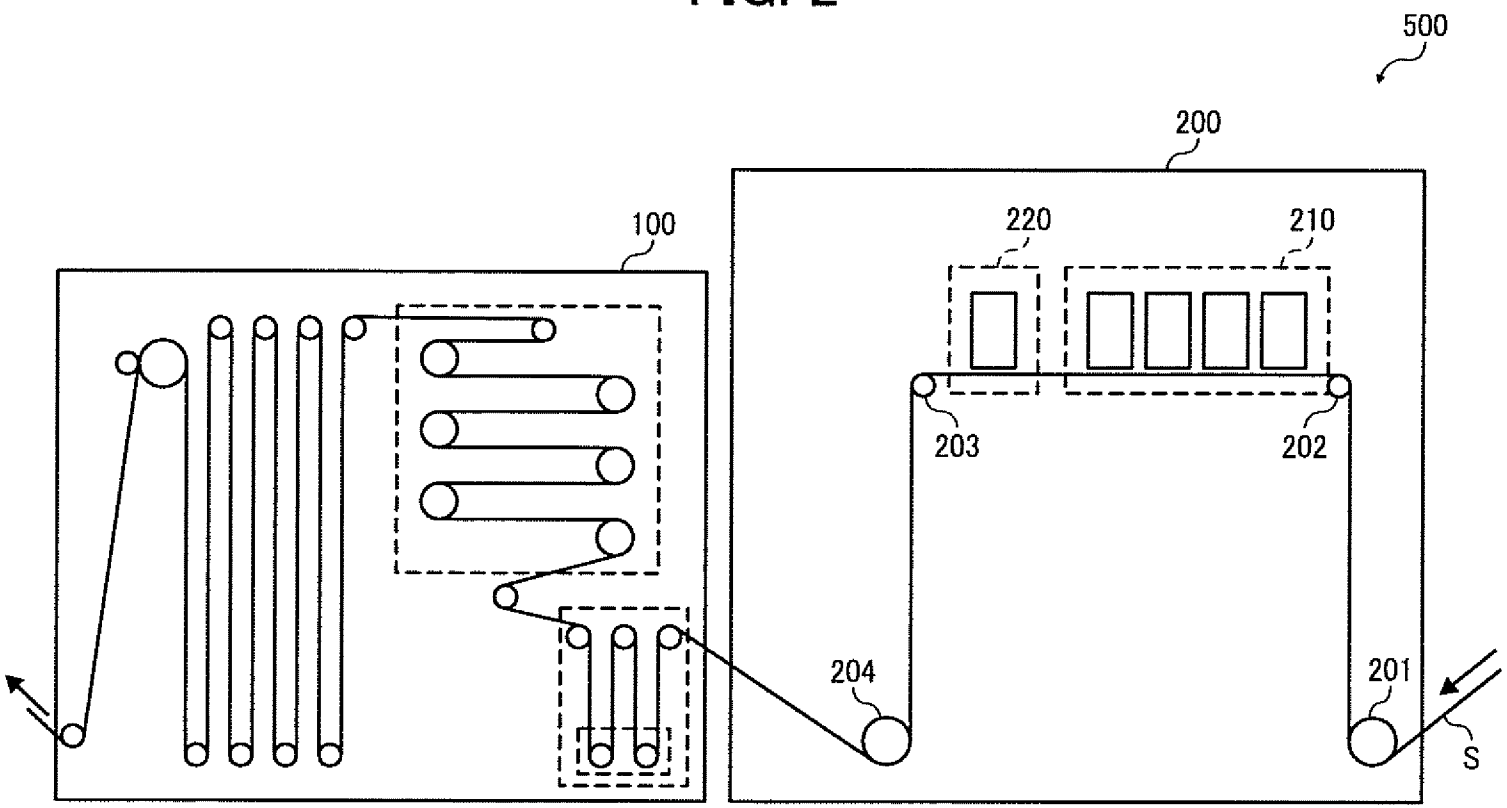
FIG. 2 is a schematic view of a drying system including the drying device illustrated in FIG. 1.

FIG. 2 is a schematic view of a drying system 500 including the drying device 100.

As illustrated in FIG. 2, the drying device 100 is disposed downstream from a printing device 200 that prints images on the sheet S in the form of a rolled sheet, to dry the sheet S having a printed image thereon. The drying device 100 is connected to the printing device 200 disposed on an upstream side from the drying device 100 relative to the sheet conveyance direction.

The sheet S is conveyed to a printing unit 210 in the printing device 200 via a conveyance roller 201 and a guide roller 202. The sheet S is then conveyed to the drying device 100 via a drying unit 220, a conveyance roller 203, and a guide roller 204.

The printing unit 210 includes an inkjet head for discharging ink. The gap between the inkjet head and the sheet S is in the range of about 1 to 2 mm.

The printing device 200 contains the drying unit 220 inside.

The drying unit 220 is for suppressing the occurrence of picking, not for suppressing the occurrence of blocking. Picking refers to an ink transfer phenomenon which occurs when ink discharged onto a printing surface of the sheet S is brought into contact with any of the rollers. Picking occurs when the ink has not been dried so much and is easily transferred onto the roller even when the contact time with the roller is short. On the other hand, blocking refers to another ink transfer phenomenon which occurs when the ink on the sheet S is highly pressurized as the sheet S is stacked or wound up, even when the ink has been dried to the degree that the occurrence of picking is suppressed.

In the drying system 500, the drying unit 220 in the printing device 200 suppresses the occurrence of picking, and the drying device 100 suppresses the occurrence of blocking.

For the purpose of raising the temperature of the sheet S, each of the upstream heating rollers 31 and 32 contains a higher-power halogen lamp or a larger number of halogen lamps than each of the downstream heating rollers 33 to 36 does. With respect to the upstream heating rollers 31 and 32, when the halogen lamp has two light-emitting units respectively disposed on rear and front sides of the drying device, the upstream heating rollers 31 and 32 are capable of outputting a larger amount of heat and applicable to variety of sheets different in width.

Each of the upstream heating rollers 31 and 32 contains two halogen lamps having different heating areas, for the purpose of drying variety of sheets different in width. Each of the downstream heating rollers 33 to 36 contains one halogen lamp having a heating area different from that of the other downstream heating rollers, for the purpose of drying variety of sheets different in width.

Figure 3:
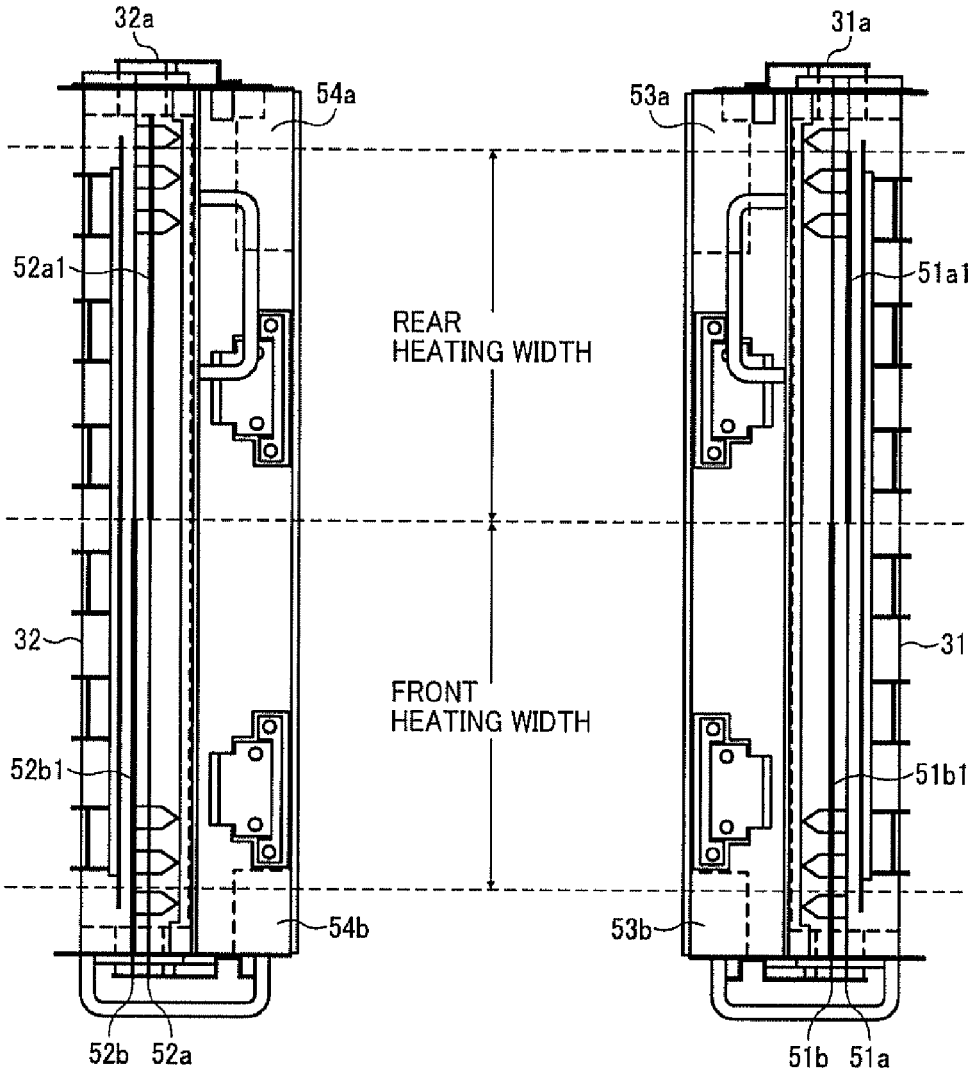
FIG. 3 is a plan view of upstream heating roller units included in the drying device illustrated in FIG. 1.
Figure 4:
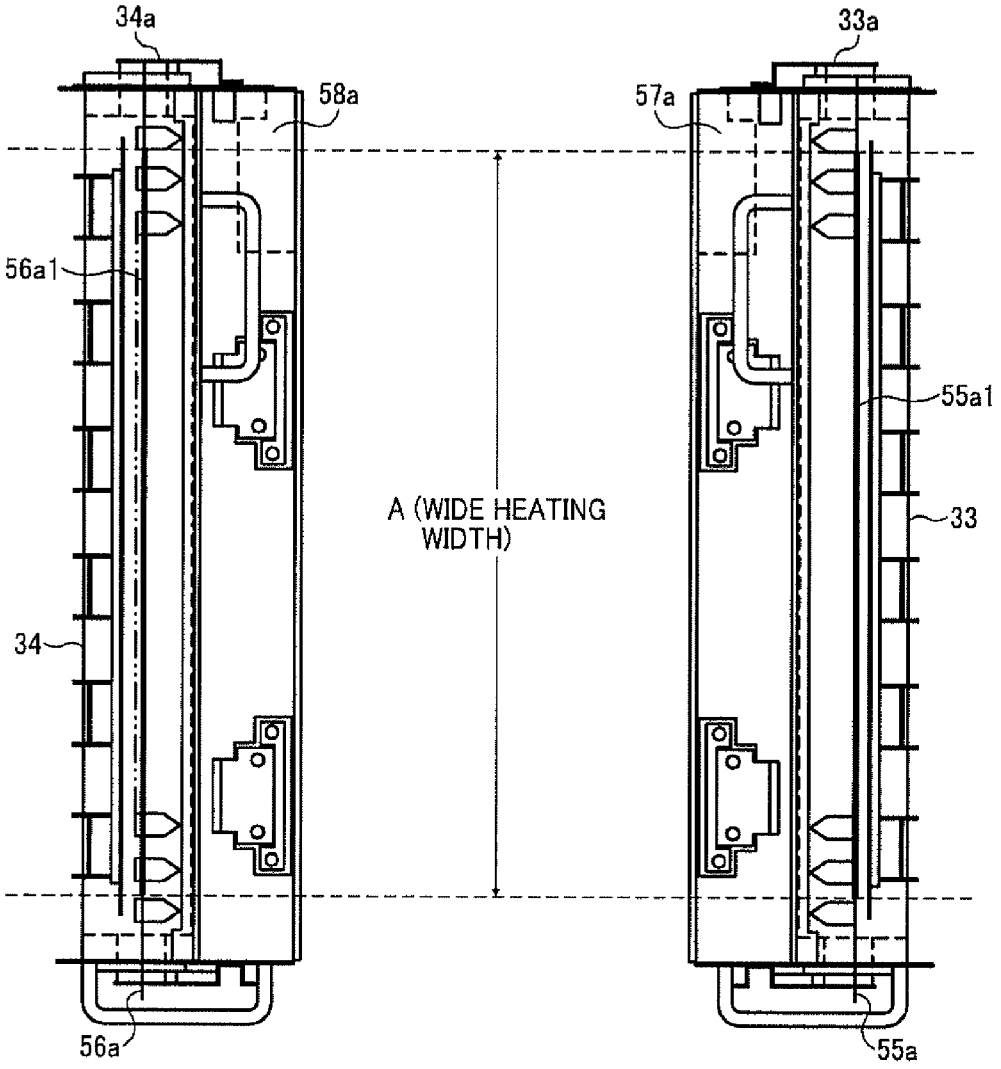
FIG. 4 is a plan view of downstream heating roller units included in the drying device illustrated in FIG. 1.
Figure 5:
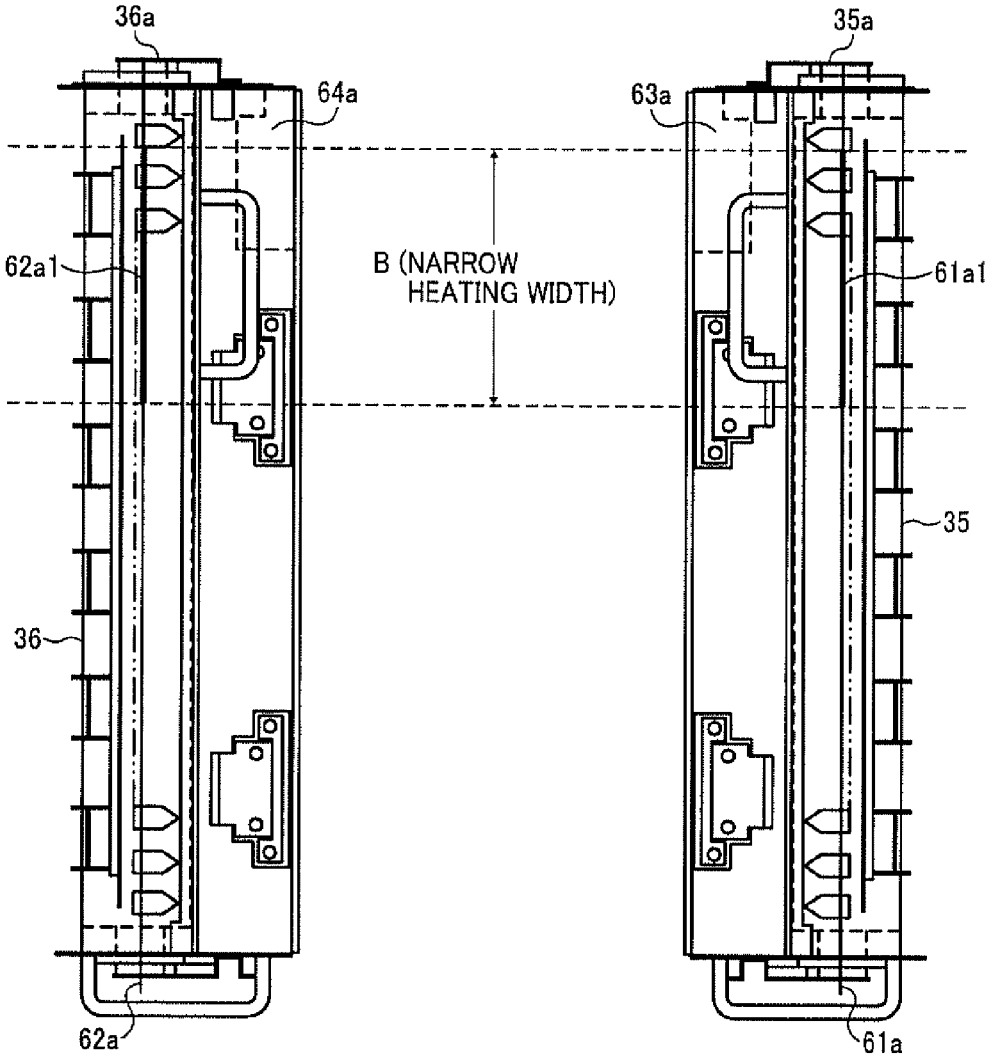
FIG. 5 is a plan view of other downstream heating roller units included in the drying device illustrated in FIG. 1.

As illustrated in FIGS. 3, 4 and 5, the heating rollers 31, 32, 33, 34, 35, and 36 are included in respective heating roller units 31*a*, 32*a*, 33*a*, 34*a*, 35*a*, and 36*a* (hereinafter collectively "heating roller units 31*a* to 36*a*"), each of which is independently detachable from the drying device 100. Each of the heating roller units 31*a* to 36*a* includes the respective heating roller, a halogen lamp, a temperature sensor serving as a temperature detector to detect the temperature of the halogen lamp, and a stay 38 or 39 (illustrated in FIG. 6). The heating roller units 31*a* to 36*a* are independently replaceable.

In FIGS. 3 to 5, the sheet S is conveyed in the lateral direction among the heating roller units 31*a* to 36*a*. In FIGS. 3 to 5, the heating roller units disposed on the right side have a different shape than those disposed on the left side.

FIG. 3 is a plan view of the upstream heating roller units 31*a* and 32*a*.

The upstream heating roller unit 31*a* includes the upstream heating roller 31, and the upstream heating roller 31 includes a rear halogen lamp 51*a* and a front halogen lamp 51*b*. The upstream heating roller 31 includes the two halogen lamps having different heating areas, for the purpose of drying variety of sheets different in width. The front halogen lamp 51*b* includes a front light-emitting unit 51*b*1 extending from the center part to the front end of the heating roller in the axial direction, thus providing a front heating area having a front heating width. The rear halogen lamp 51*a* includes a rear light-emitting unit 51*a*1 extending from the center part to the rear end of the heating roller in the axial direction, thus providing a rear heating area having a rear heating width. The total of the front heating width and the rear heating width encompasses the maximum possible width of the sheet S usable for the drying device 100. The rear light-emitting unit 51*a*1 and front light-emitting unit 51*b*1 are disposed upstream and downstream, respectively, relative to the sheet conveyance direction.

On upper parts relative to the vertical direction and both downstream ends relative to the sheet conveyance direction of the casing of the upstream heating roller unit 31*a*, a rear temperature sensor 53*a* and a front temperature sensor 53*b* are respectively disposed. The rear temperature sensor 53*a* and the front temperature sensor 53*b* detect the temperatures of the rear light-emitting unit 51*a*1 and the front light-emitting unit 51*b*1, respectively. The detected temperatures are converted into electric signals and transmitted to respective controllers each disposed in the rear halogen lamp 51*a* and the front halogen lamp 51*b*. The controllers on-off control the rear halogen lamp 51*a* and the front halogen lamp 51*b*.

In a case in which the sheet S being conveyed has a width which covers the entire rear heating area and a half of the front heating area closer to the center part of the unit, the sheet S never covers the other half of the heating area closer to the front end of the unit while being conveyed, and therefore a temperature rise is easily caused. To prevent an excessive temperature rise, when the temperature detected by the front temperature sensor 53*b* exceeds a preset value, the controller stops supplying power to the front halogen lamp 51*b*. When the temperature detected by the front temperature sensor 53*b* falls below the preset value, the controller restarts supplying power to the front halogen lamp 51*b*.

In a case in which the width of the sheet S is smaller than the heating width of the upstream heating rollers 31 and 32, a part of each of the upstream heating rollers 31 and 32 on which the sheet S never passes is excessively heated, causing breakdown of the drying device. To prevent such a phenomenon, the upstream heating rollers 31 and 32 each include multiple halogen lamps having different heating widths to be applicable to various types of sheets having different widths. Thus, the drying device 100 is capable of appropriately heating the sheet S without any complicated control.

The upstream heating roller unit 32*a* includes the upstream heating roller 32, and the upstream heating roller 32 includes a rear halogen lamp 52*a* and a front halogen lamp 52*b*. The upstream heating roller 32 includes the two halogen lamps having different heating areas, for the purpose of drying variety of sheets different in width. The front halogen lamp 52*b* includes a front light-emitting unit 52*b*1 extending from the center part to the front end of the heating roller in the axial direction, thus providing a front heating area having a front heating width. The rear halogen lamp 52*a* includes a rear light-emitting unit 52*a*1 extending from the center part to the rear end of the heating roller in the axial direction, thus providing a rear heating area having a rear heating width. The total of the front heating width and the rear heating width encompasses the maximum possible width of the sheet S usable for the drying device 100. The rear light-emitting unit 52*a*1 and front light-emitting unit 52*b*1 are disposed upstream and downstream, respectively, relative to the sheet conveyance direction.

On upper parts relative to the vertical direction and both upstream ends relative to the sheet conveyance direction of the casing of the upstream heating roller unit 32*a*, a rear temperature sensor 54*a* and a front temperature sensor 54*b* are respectively disposed. The rear temperature sensor 54*a* and the front temperature sensor 54*b* detect the temperatures of the rear light-emitting unit 52*a*1 and the front light-emitting unit 52*b*1, respectively. The detected temperatures are converted into electric signals and transmitted to respective controllers each disposed in the rear halogen lamp 52*a* and the front halogen lamp 52*b*. The controllers on-off control the rear halogen lamp 52*a* and the front halogen lamp 52*b*.

Examples of the temperature sensors include a thermopile that is one of non-contact temperature sensors.

Each of the upstream heating roller units includes two heat sources extending from respective axial ends and two temperature sensors for detecting the temperatures of the respective heat sources disposed at the respective axial ends. The upstream heating roller unit further includes at least one and at most two controllers. Since the sheet S is conveyed with the rear end thereof aligned with the rear end of the heating rollers 31 and 32, there may be a case in which the sheet S never covers front-side parts of the heating rollers 31 and 32 while being conveyed. In this case, an unnecessary temperature rise may be caused on the front-side parts. Thus, it is necessary that the temperature sensors detect and the controllers control the temperature of the front-side parts.

FIG. 4 is a plan view of the downstream heating roller units 33*a* and 34*a*.

The downstream heating roller unit 33*a* includes the downstream heating roller 33, and the downstream heating roller 33 includes a halogen lamp 55*a*. The halogen lamp 55*a* includes a light-emitting unit 55*a*1 extending from the front end to the rear end of the heating roller in the axial direction, thus providing a heating area having a wide heating width A encompassing the maximum possible width of the sheet S.

On an upper part relative to the vertical direction and the rear downstream end relative to the sheet conveyance direction of the casing of the downstream heating roller unit 33*a*, a rear temperature sensor 57*a* is disposed. No front temperature sensor is disposed on the front end. The rear temperature sensor 57*a* detects the temperature of the light-emitting unit 55*a*1. The detected temperature is converted into an electric signal and transmitted to a controller disposed in the halogen lamp 55*a*. The controller on-off controls the halogen lamp 55*a*.

The downstream heating roller unit 34*a* includes the downstream heating roller 34, and the downstream heating roller 34 includes a halogen lamp 56*a*. The halogen lamp 56*a* includes a light-emitting unit 56*a*1 extending from the front end to the rear end of the heating roller in the axial direction, thus providing a heating area having a wide heating width A encompassing the maximum possible width of the sheet S.

On an upper part relative to the vertical direction and the rear upstream end relative to the sheet conveyance direction of the casing of the downstream heating roller unit 34*a*, a rear temperature sensor 58*a* is disposed. No front temperature sensor is disposed on the front end. The rear temperature sensor 58*a* detects the temperature of the light-emitting unit 56*a*1. The detected temperature is converted into an electric signal and transmitted to a controller disposed in the halogen lamp 56*a*. The controller on-off controls the halogen lamp 56*a*.

FIG. 5 is a plan view of the downstream heating roller units 35*a* and 36*a*.

The downstream heating roller unit 35*a* includes the downstream heating roller 35, and the downstream heating roller 35 includes a halogen lamp 61*a*. The halogen lamp 61*a* includes a light-emitting unit 61*a*1 extending from the rear end of the heating roller in the axial direction, thus providing a heating area having a narrow heating width B.

On an upper part relative to the vertical direction and the rear downstream end relative to the sheet conveyance direction of the casing of the downstream heating roller unit 35*a*, a rear temperature sensor 63*a* is disposed. The rear temperature sensor 63*a* detects the temperature of the light-emitting unit 61*a*1. The detected temperature is converted into an electric signal and transmitted to a controller disposed in the halogen lamp 61*a*. The controller on-off controls the halogen lamp 61*a*.

The downstream heating roller unit 36*a* includes the downstream heating roller 36, and the downstream heating roller 36 includes a halogen lamp 62*a*. The halogen lamp 62*a* includes a light-emitting unit 62*a*1 extending from the rear end of the heating roller in the axial direction, thus providing a heating area having a narrow heating width B.

On an upper part relative to the vertical direction and the rear upstream end relative to the sheet conveyance direction of the casing of the downstream heating roller unit 36*a*, a rear temperature sensor 64*a* is disposed. The rear temperature sensor 64*a* detects the temperature of the light-emitting unit 62*a*1. The detected temperature is converted into an electric signal and transmitted to a controller disposed in the halogen lamp 62*a*. The controller on-off controls the halogen lamp 62*a*.

In the drying device 100, the heating widths of the heating roller units 31*a* to 36*a* are variable depending on the width of the sheet S to be dried and the amount of heat required for drying the sheet S.

As an example, the downstream heating rollers 33 and 34 may have the same heating width, as illustrated in FIG. 4. As another example, the downstream heating rollers 35 and 36 may have the same heating width, as illustrated in FIG. 5. Alternatively, the downstream heating rollers 33 and 34 may have different heating widths, the downstream heating rollers 35 and 36 may have different heating widths, and/or all the downstream heating rollers may have heating widths different from each other.

On the other hand, the output of the entire drying device 100 is invariable. For example, if all the six heating roller units have an output equivalent to that of the upstream heating rollers 31 and 32, the total output of the six heating roller units will exceed the output of the drying device 100. The total output of the six heating roller units should be adjusted so as not to exceed the output of the drying device 100. Thus, the drying device 100 includes detectors for detecting outputs of the heating roller units 31*a* to 36*a* and controllers for controlling the outputs of the heating roller units 31*a* to 36*a* by receiving electric signals transmitted from the detectors. Owing to this configuration, it is possible that each one of the units having a narrow heating width contains a heat source having a high heat value per unit length, so as to give a larger amount of heat to the sheet S.

As an example, when the output of the drying device 100 is 18.1 kW, the heating widths and outputs of the heating roller units 31*a* to 36*a* and the number of heat sources included therein are controlled by the detectors and controllers according to Table 1. In this case, the total output of the heating roller units becomes 17.8 kW. It is to be noted that the number of heat sources in each of the heating roller units 31*a* and 32*a* is not always two, and is variable depending on the temperatures of the heating rollers 31 and 32.

TABLE 1

| Heating Roller Units | Heating Widths | Number of Heat Sources | Output (kW) |
|---|---|---|---|
| Heating Roller Unit 31a | Variable by Heat Source Control | 2 | 5.8 |
| Heating Roller Unit 32a | Variable by Heat Source Control | 2 | 5.8 |
| Heating Roller Unit 33a | A (Wide) | 1 | 1.8 |
| Heating Roller Unit 34a | A (Wide) | 1 | 1.8 |
| Heating Roller Unit 35a | B (Narrow) | 1 | 1.3 |
| Heating Roller Unit 36a | B (Narrow) | 1 | 1.3 |

Figure 6:
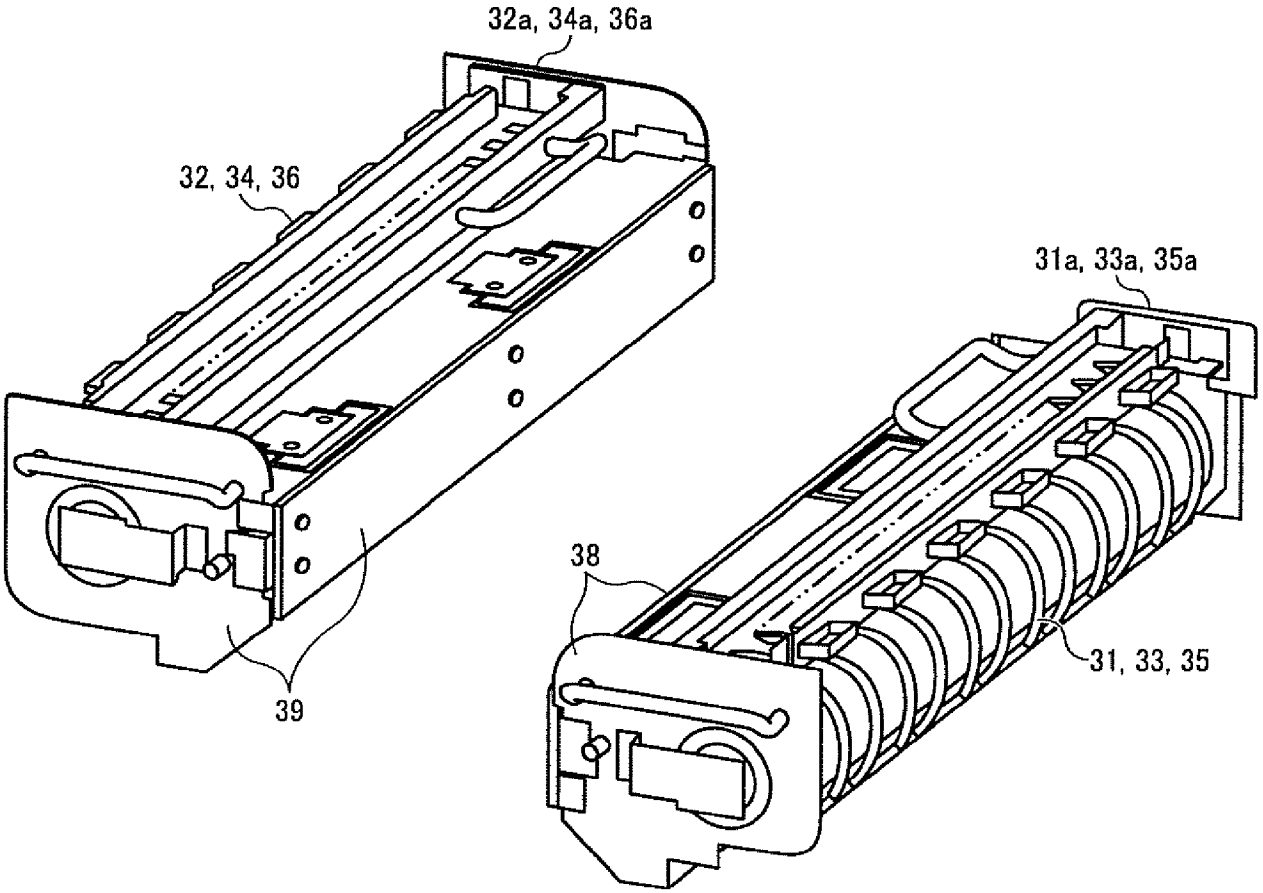
FIG. 6 is a perspective view of a pair of heating roller units included in the drying device illustrated in FIG. 1.

FIG. 6 is a perspective view of a pair of heating roller units.

The heating roller units 31*a*, 33*a*, and 35*a*, each of which is disposed on an upstream side relative to the sheet conveyance direction (a right side in FIG. 6), have the same shape. The heating roller units 32*a*, 34*a*, and 36*a*, each of which is disposed on a downstream side relative to the sheet conveyance direction (a left side in FIG. 6), have the same shape.

Figure 7B:
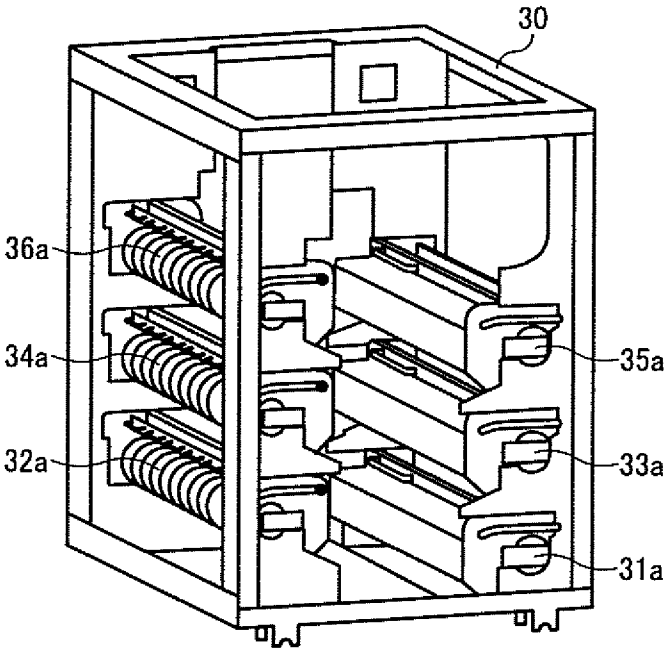
FIGS. 7A and 7B are perspective views of a sheet drying unit included in the drying device illustrated in FIG. 1.
Figure 7A:
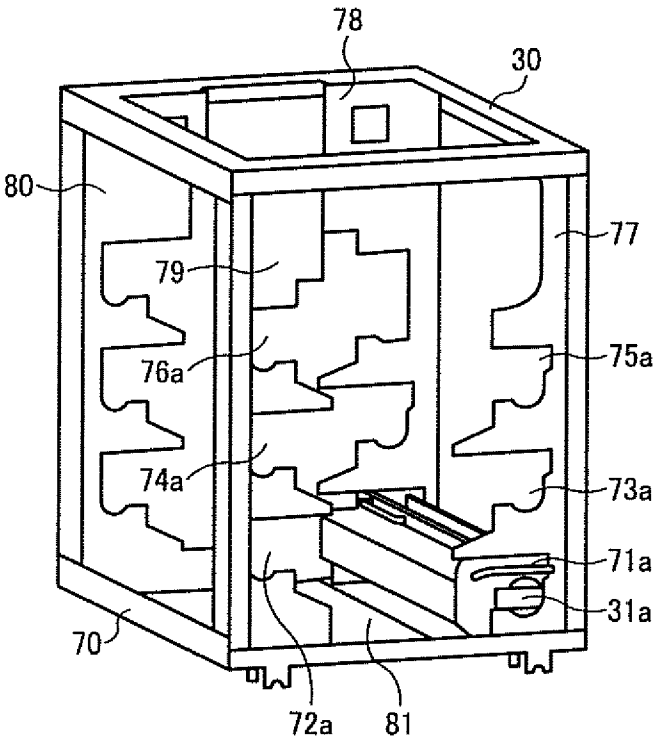

FIGS. 7A and 7B are perspective views of the sheet drying unit 30. In FIG. 7A, the heating roller unit 31*a* is mounted to a casing 70 of the sheet drying unit 30. In FIG. 7B, the heating roller units 31*a* to 36*a* are mounted to the casing 70 of the sheet drying unit 30.

As illustrated in FIG. 7A, the casing 70 includes a frame having a rectangular-cuboid shape. On the right end of the front surface of the casing 70, a stationary plate 77 is fixed. The stationary plate 77 has multiple projections projecting toward the center of the front surface of the casing 70 in the horizontal direction. On the right end of the rear surface of the casing 70, a stationary plate 78 is fixed. The stationary plate 78 has multiple projections projecting toward the center of the rear surface of the casing 70 in the horizontal direction. Moreover, the stationary plates 77 and 78 each have recesses 71*a*, 73*a*, and 75*a* formed between each pair of adjacent projections. The recesses 71*a*, 73*a*, and 75*a* are configured to receive and support the heating roller units 31*a*, 33*a*, and 35*a*, respectively. On the left end of the front surface of the casing 70, a stationary plate 79 is fixed. The stationary plate 79 has multiple projections projecting toward the center of the front surface of the casing 70 in the horizontal direction. On the right end of the rear surface of the casing 70, a stationary plate 80 is fixed. The stationary plate 80 has multiple projections projecting toward the center of the rear surface of the casing 70 in the horizontal direction. Moreover, the stationary plates 79 and 80 each have recesses 72*a*, 74*a*, and 76*a* formed between each pair of adjacent projections. The recesses 72*a*, 74*a*, and 76*a* are configured to receive and support the heating roller units 32*a*, 34*a*, and 36*a*, respectively. The recesses 71*a* support respective ends of the heating roller 31 of the heating roller unit 31*a*.

Each recess has a U-shaped bottom where an end of the heating roller of each heating roller unit is to be put on, thus easily securing the heating roller unit. On a center part of the front surface of the casing 70, a large opening 81 is formed. User can easily put the heating roller unit on the recess through the opening 81. Moreover, user can easily remove the heating roller unit from the recess and replace with a new heating roller unit through the opening 81. Thus, each heating roller unit is detachably mountable to each recess. In other words, each heating roller unit is detachably mountable to the drying device 100. As described above, in each of the upstream heating roller units 31*a* and 32*a*, multiple halogen lamps and multiple temperature sensors for detecting the temperatures of the halogen lamps are integrated. In each of the downstream heating roller units 33*a* to 36*a*, one halogen lamp and one temperature sensor for detecting the temperature of the halogen lamp are integrated. Accordingly, at the time of replacing the heating roller unit with a new one, there is no need to install and adjust new halogen lamps and temperature sensors.

As illustrated in FIGS. 4 and 5, the halogen lamps 55*a*, 56*a*, 61*a*, and 62*a*, respectively included in the downstream heating roller units 33*a*, 34*a*, 35*a*, and 36*a*, each include one low-output heater. Each low-output heater includes a light-emitting unit having a different length so as to correspond to various heating widths. To continuously dry ink on the sheet S, the downstream heating rollers need some quantity of heat to prevent a decrease in temperature of the sheet S even when release of latent heat (vaporization heat) occurs upon drying of ink. The only one low-output heater is enough for providing necessary amount of heat for drying ink on the sheet S.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A drying device for drying a recording medium, comprising:

at least one upstream heating roller unit, each including:

an upstream heating roller including two upstream heat sources inside the upstream heating roller;

two or more stay members, the upstream heating roller extending in an axial direction and being disposed, in the axial direction, between two of the stay members of the upstream heating roller unit; and two upstream temperature detectors disposed at respective end parts of the upstream heating roller, to detect temperatures of the respective upstream heat sources, wherein for each upstream heating roller unit amongst said at least one upstream heating roller unit, the upstream heating roller, the two or more stay members and the two upstream temperature detectors of the upstream heating roller unit are integrated, and the upstream heating roller unit is independently detachable from the drying device.

2. The drying device of claim 1, further comprising at least one downstream heating roller unit, each including:

a downstream heating roller including a downstream heat source inside the downstream heating roller; and a downstream temperature detector disposed at an end part of the downstream heating roller, to detect a temperature of the downstream heat source, wherein for each downstream heating roller unit amongst the at least one downstream heating roller unit, the downstream heating roller and the downstream temperature detector are integrated, and the downstream heating roller unit is independently detachable from the drying device.

3. The drying device of claim 2, wherein the at least one downstream heating roller unit includes a first downstream heating roller unit disposed upstream relative to a conveyance direction of the recording medium, and the first downstream heating roller unit comprises:

a first downstream heating roller including a first downstream heat source including a first light emitting unit; and a second downstream heating roller unit disposed downstream relative to the conveyance direction of the recording medium and comprises: a second downstream heating roller including a second downstream heat source including a second light emitting unit, and wherein the second light emitting unit is shorter than the first light emitting unit in length.

4. The drying device of claim 1, further comprising a detector to detect output of the at least one upstream heating roller unit.

5. A drying system comprising:

a printing device to print an image on a recording medium; and the drying device of claim 1 to dry the recording medium having a printed image.

6. The drying device of claim 1, wherein the two upstream temperature detectors have respective light emitting units, and wherein the light emitting units are disposed on different positions of the upstream heating roller in a longitudinal direction.

7. The drying device of claim 1, wherein for each upstream heating roller unit, the stay members include:

a first plate member extending in the axial direction of the upstream heating roller; and two second plate members each intersecting with the axial direction, wherein the upstream heating roller is surrounded by the first plate member and the two second plate members.

8. A drying device for drying a recording medium, comprising:

at least one upstream heating roller unit, each including:

an upstream heating roller including two upstream heat sources inside the upstream heating roller; and two upstream temperature detectors disposed at respective end parts of the upstream heating roller, to detect temperatures of the respective upstream heat sources; and at least one downstream heating roller unit, each including:

a downstream heating roller including a downstream heat source inside the downstream heating roller; and a downstream temperature detector disposed at an end part of the downstream heating roller, to detect a temperature of the downstream heat source, wherein for each upstream heating roller unit amongst said at least one upstream heating roller unit, the upstream heating roller and the two upstream temperature detectors of the upstream heating roller unit are integrated, and the upstream heating roller unit including the two upstream temperature detectors integrated with the upstream heating roller is independently detachable from the drying device, wherein for each downstream heating roller unit amongst the at least one downstream heating roller unit, the downstream heating roller and the downstream temperature detector are integrated, and the downstream heating roller unit is independently detachable from the drying device, wherein the at least one downstream heating roller unit includes a first downstream heating roller unit disposed upstream relative to a conveyance direction of the recording medium, and the first downstream heating roller unit comprises:

a first downstream heating roller including a first downstream heat source including a first light emitting unit; and a second downstream heating roller unit disposed downstream relative to the conveyance direction of the recording medium and comprises: a second downstream heating roller including a second downstream heat source including a second light emitting unit, and wherein the second light emitting unit is shorter than the first light emitting unit in length.

9. The drying device of claim 8, further comprising a detector to detect output of the at least one upstream heating roller unit.

10. A drying system comprising:

a printing device to print an image on a recording medium; and the drying device of claim 9 to dry the recording medium having a printed image.

* * * * *